US007518269B2

(12) United States Patent
Lee

(10) Patent No.: US 7,518,269 B2
(45) Date of Patent: Apr. 14, 2009

(54) ACTUATOR USING PERMANENT MAGNET

(75) Inventor: Jong-Hyuk Lee, Busan (KR)

(73) Assignee: LS Industrial Systems Co., Ltd., Seoul (KR)

( * ) Notice: Subject to any disclaimer, the term of this patent is extended or adjusted under 35 U.S.C. 154(b) by 421 days.

(21) Appl. No.: 11/374,342

(22) Filed: Mar. 14, 2006

(65) Prior Publication Data

US 2006/0208591 A1 Sep. 21, 2006

(30) Foreign Application Priority Data

Mar. 18, 2005 (KR) ..... 10-2005-0022862

(51) Int. Cl.
*H02K 41/00* (2006.01)

(52) U.S. Cl. ..... 310/12; 335/200

(58) Field of Classification Search ..... 310/12, 310/14, 15, 36; 335/200
See application file for complete search history.

(56) References Cited

U.S. PATENT DOCUMENTS 3,886,507 A 5/1975 Johnston et al.
4,859,975 A 8/1989 Uetsuhara
6,933,827 B2 8/2005 Takeuchi et al.
2001/0007440 A1 * 7/2001 Oyama et al. ..... 335/200
2004/0093718 A1 5/2004 Takeuchi et al.
2005/0218749 A1 10/2005 Shin et al. ..... 310/217

FOREIGN PATENT DOCUMENTS

CN 1501414 A 6/2004

* cited by examiner

*Primary Examiner*—Javaid Nasri
(74) *Attorney, Agent, or Firm*—Greenblum & Bernstein, P.L.C.

(57) ABSTRACT

An actuator using a permanent magnet comprises: a first core and a second core facing each other with a certain gap and having a space therein; a hollow bobbin coil fixedly installed at one side of the space for generating a magnetic force at the time of a current supply; a stator fixedly installed at another side of the space with a certain gap from the bobbin coil; a mover linearly moving in the space by a magnetic force generated by the bobbin coil, and having a rod portion exposed to outside of the first core and the second core; and a permanent magnet fixedly installed at an inner surface of the space for fixing the mover. In the actuator, one bobbin coil is provided thus to lower a production cost, and a driving function is enhanced. Accordingly, the actuator can be widely applied to a vacuum circuit breaker or a high speed transfer switch requiring a fast driving.

12 Claims, 7 Drawing Sheets

ACTUATOR USING PERMANENT MAGNET

BACKGROUND OF THE INVENTION

1. Field of the Invention

The present invention relates to an actuator using a permanent magnet, and more particularly, to an actuator using a permanent magnet capable of opening and closing a contact point of a vacuum circuit breaker or a high speed transfer switch.

2. Description of the Conventional Art

Generally, an actuator using a permanent magnet is used as a driving source for opening and closing a contact point of a vacuum circuit breaker, a high speed transfer switch, etc.

FIG. 1 is a perspective view showing an actuator using a permanent magnet in accordance with the conventional art, and FIG. 2 is a longitudinal section view showing the actuator using a permanent magnet in accordance with the conventional art.

As shown, the conventional actuator 10 using a permanent magnet comprises a first core 11 and a second core 12 facing each other with a certain gap, a space 13 formed between the first core 11 and the second core 12, an upper bobbin coil 14 installed at an upper portion of the space 13, and a lower bobbin coil 15 installed at a lower portion of the space 13.

A permanent magnet 16 is disposed between the upper bobbin coil 14 and the lower bobbin coil 15, and a mover 17 linearly moved by a magnetic force generated by the upper bobbin coil 14 and the lower bobbin coil 15 is installed at the space 13.

A rod portion 18 exposed to outside of the first core 11 and the second core 12 is respectively provided at both sides of the mover 17.

In the conventional actuator using a permanent magnet, when a current is applied to the upper bobbin coil 14 or the lower bobbin coil 15, the mover 17 is linearly moved in upper and lower directions by a magnetic force generated by the current. When the mover 17 has moved to a certain position, the mover 17 is fixed by a force of the permanent magnet 16.

However, in the conventional actuator using a permanent magnet, the upper and lower bobbin coils are disposed to face each other in upper and lower directions in order to drive the mover, and the permanent magnet is disposed between the upper and lower bobbin coils. Under the structure, an initial driving function is greatly degraded and thus an initial driving time is delayed.

Furthermore, since the two bobbin coils are provided in the conventional actuator, the entire construction is complicated and a production cost is increased.

BRIEF DESCRIPTION OF THE INVENTION

Therefore, an object of the present invention is to provide an actuator using a permanent magnet capable of being applied to a vacuum circuit breaker or a high speed transfer switch by having one bobbin coil and by enhancing an initial driving function with a small current.

To achieve these and other advantages and in accordance with the purpose of the present invention, as embodied and broadly described herein, there is provided an actuator using a permanent magnet, comprising: a first core and a second core facing each other with a certain gap and having a space therein; a hollow bobbin coil fixedly installed at one side of the space for generating a magnetic force at the time of a current supply; a stator fixedly installed at another side of the space with a certain gap from the bobbin coil; a mover linearly moving in the space by a magnetic force generated by the bobbin coil, and having a rod portion exposed to outside of the first core and the second core; and a permanent magnet fixedly installed at an inner surface of the space for fixing the mover.

Preferably, an elastic member for elastically linear-moving the mover is disposed between the mover and the stator.

Preferably, a flange portion is extendingly formed at an outer circumferential surface of the stator, and an end of the permanent magnet is supported by the flange portion.

Preferably, the permanent magnets are disposed to face each other on the basis of the mover.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, an actuator using a permanent magnet according to the present invention will be explained in more detail with reference to the attached drawing.

Figure 1:
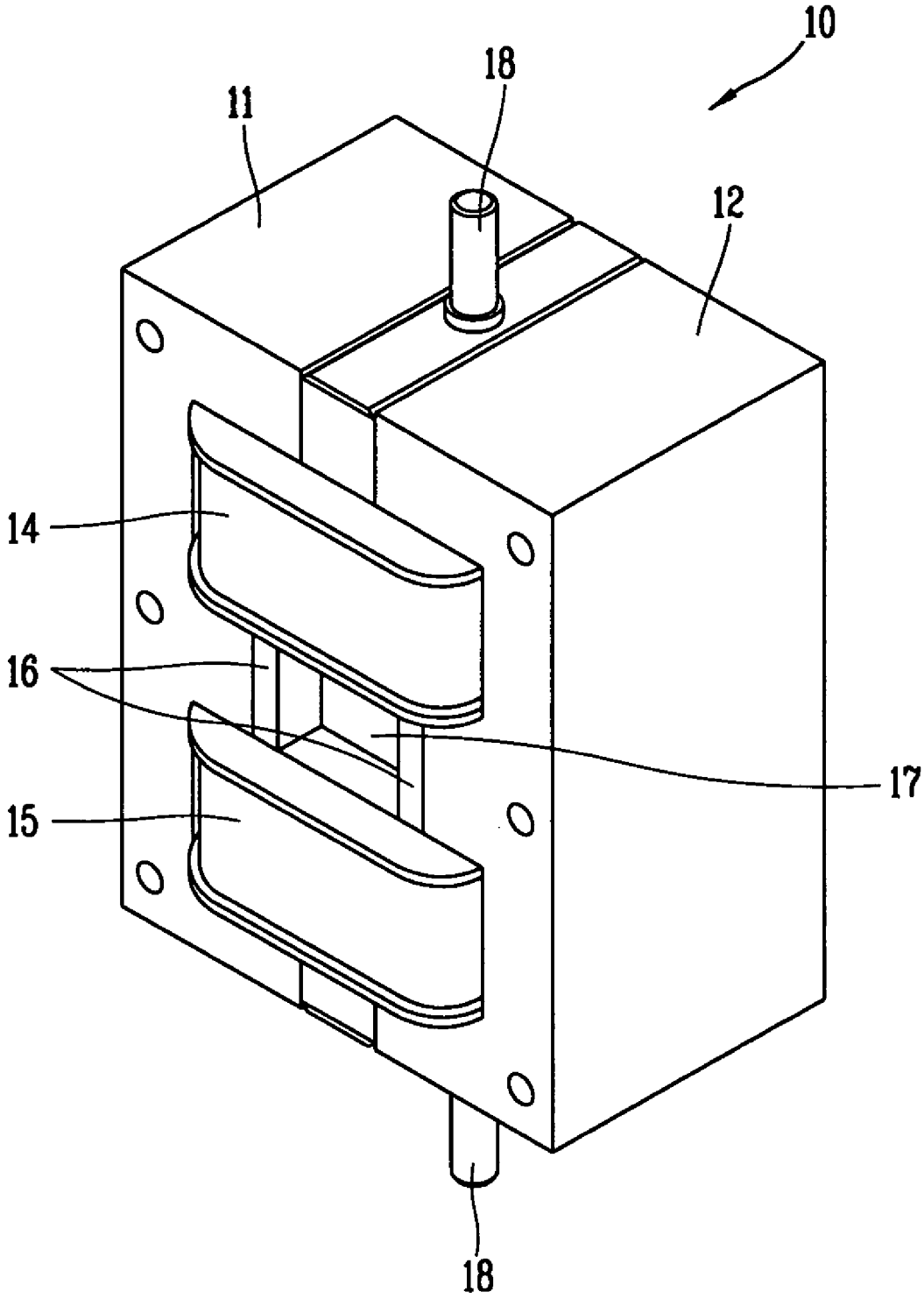
FIG. 1 CONVENTIONAL ART
FIG. 1 is a perspective view showing an actuator using a permanent magnet in accordance with the conventional art.
Figure 2:
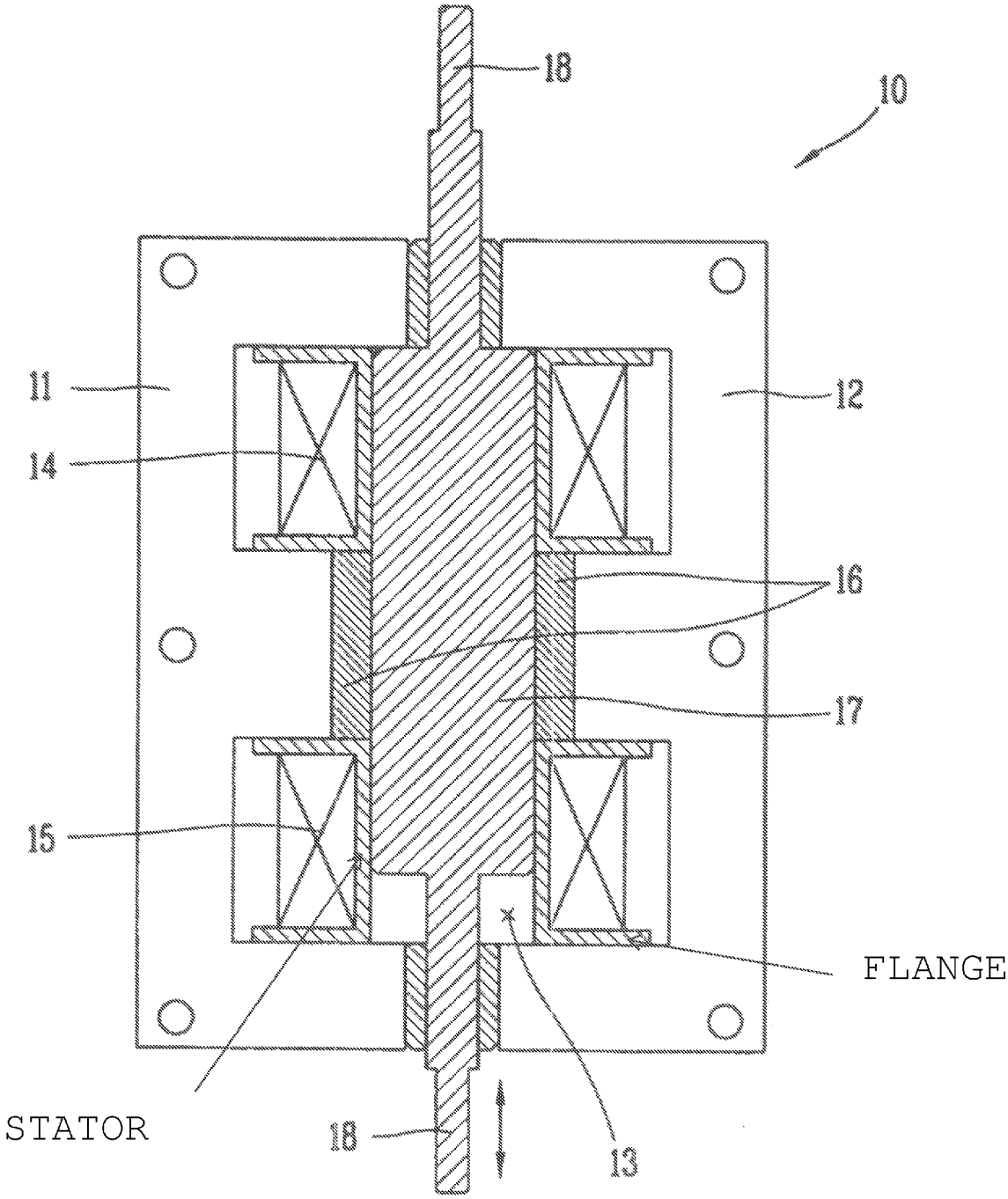
FIG. 2 CONVENTIONAL ART
FIG. 2 is a longitudinal section view showing the actuator using a permanent magnet in accordance with the conventional art.
Figure 3:
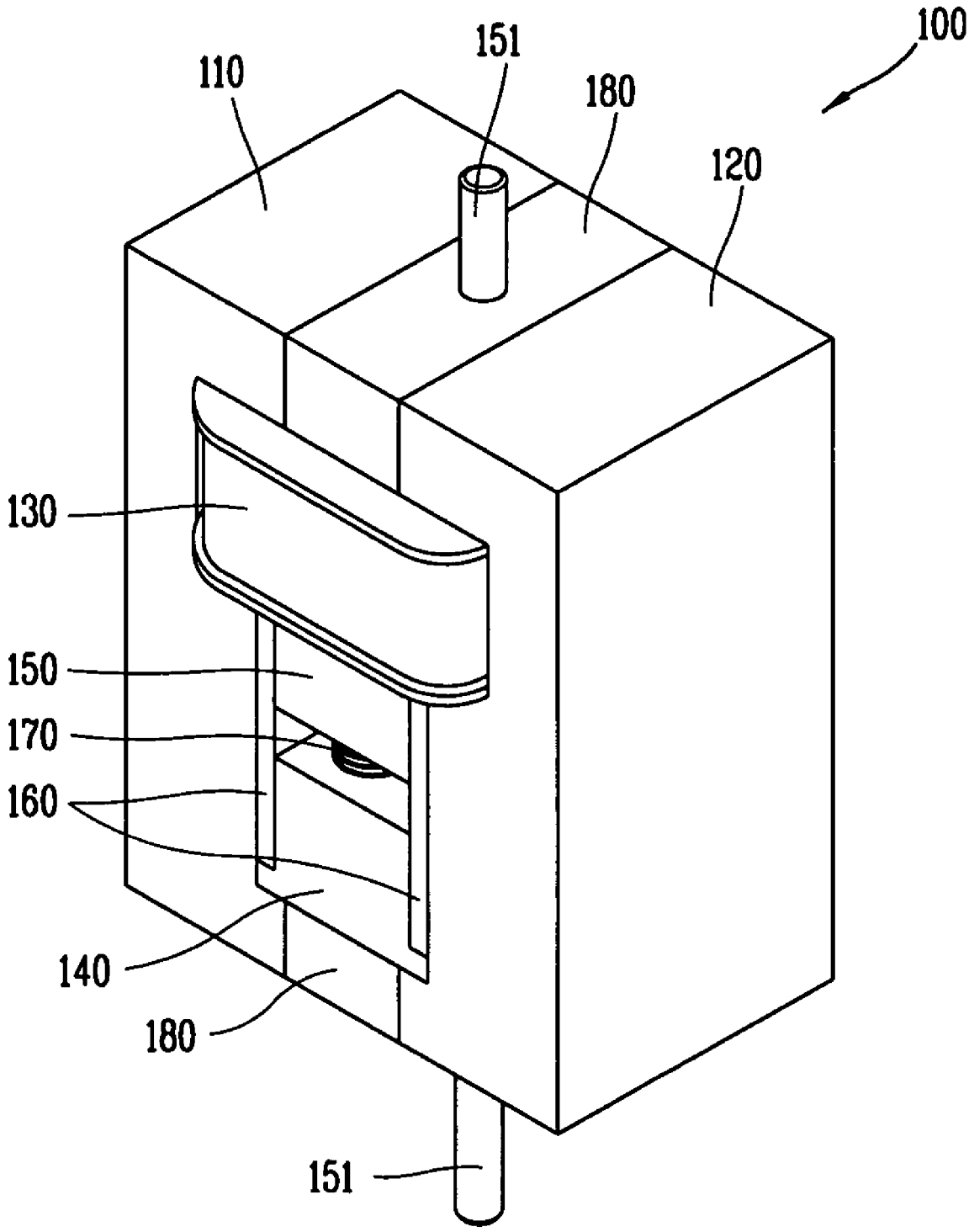
FIG. 3 is a perspective view showing an actuator using a permanent magnet according to the present invention.
Figure 4:
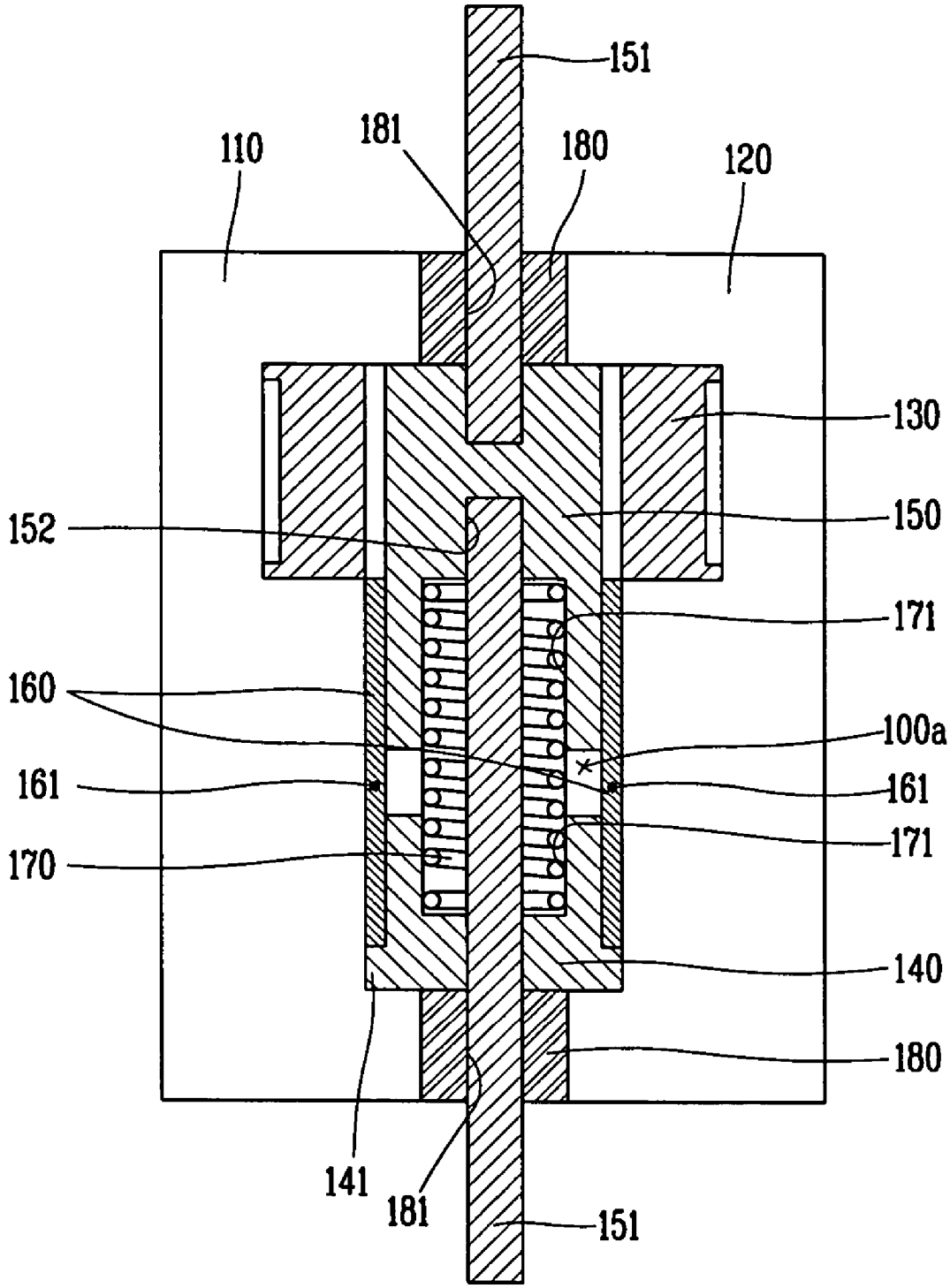
FIG. 4 is a longitudinal section view showing the actuator using a permanent magnet according to the present invention.
Figure 5:
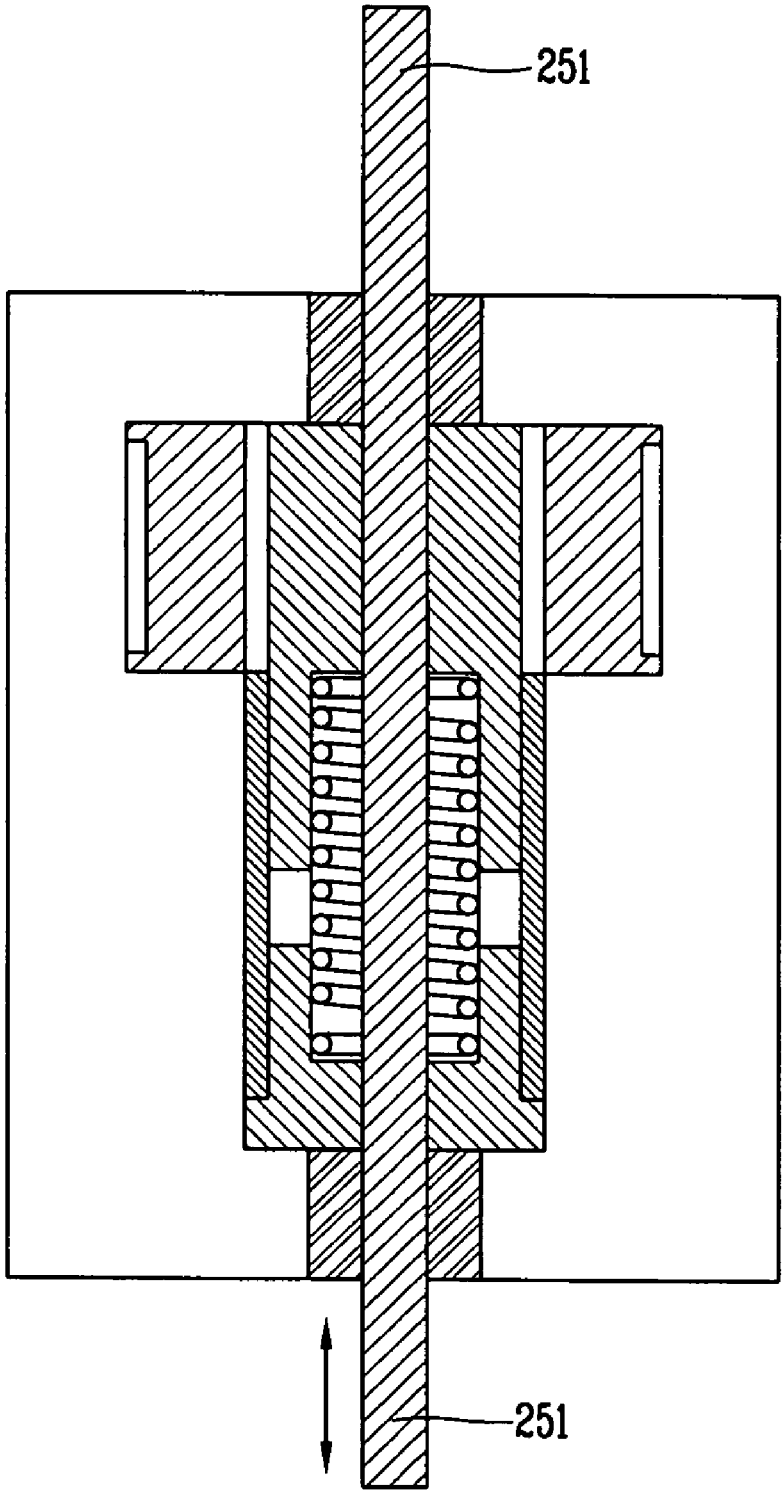
FIG. 5 is a longitudinal section view showing another example of a rod portion of the actuator using a permanent magnet according to the present invention.
Figure 6:
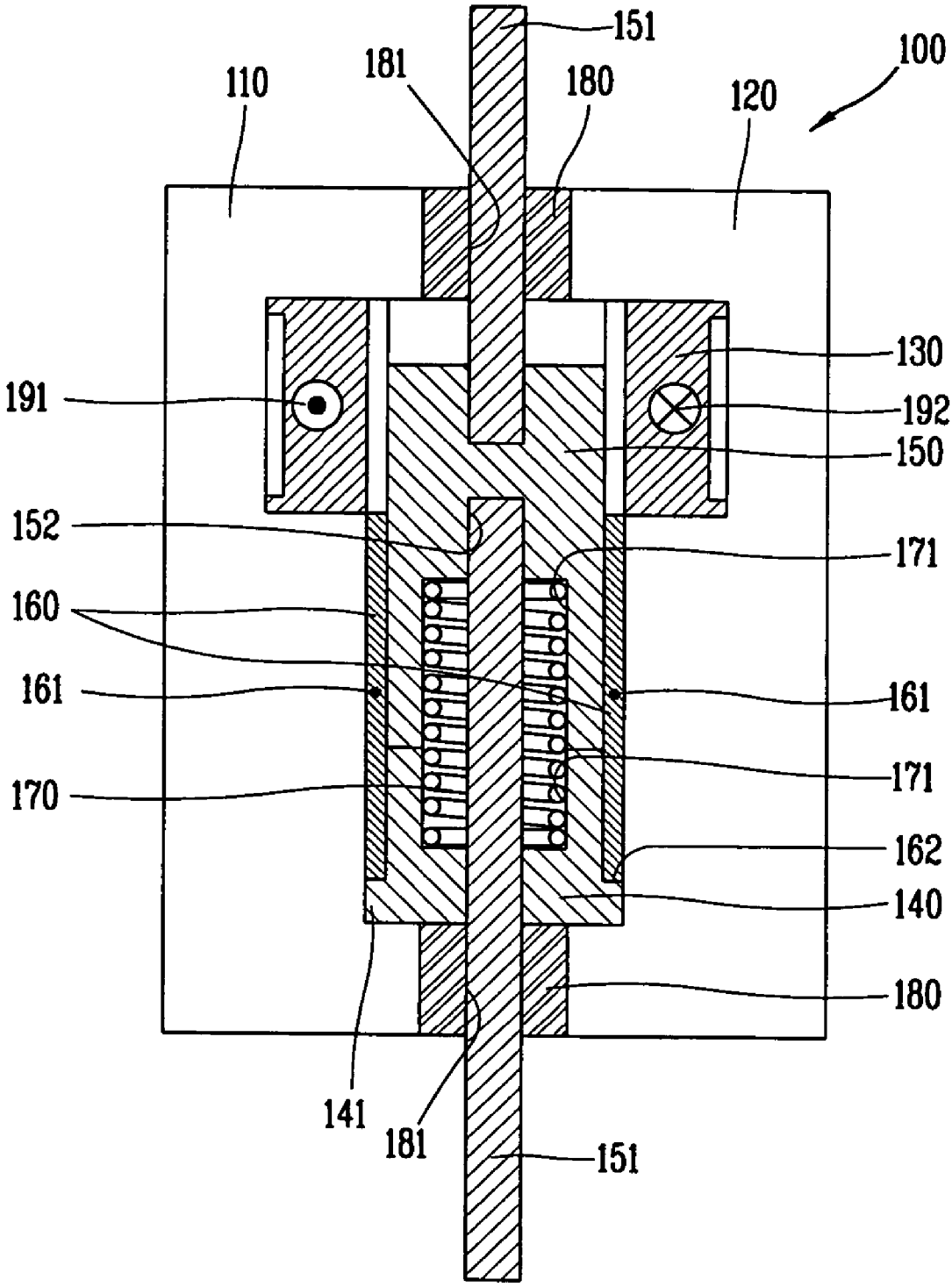
FIGS. 6 and 7 are longitudinal section views showing an operation of the actuator using a permanent magnet according to the present invention.
Figure 7:
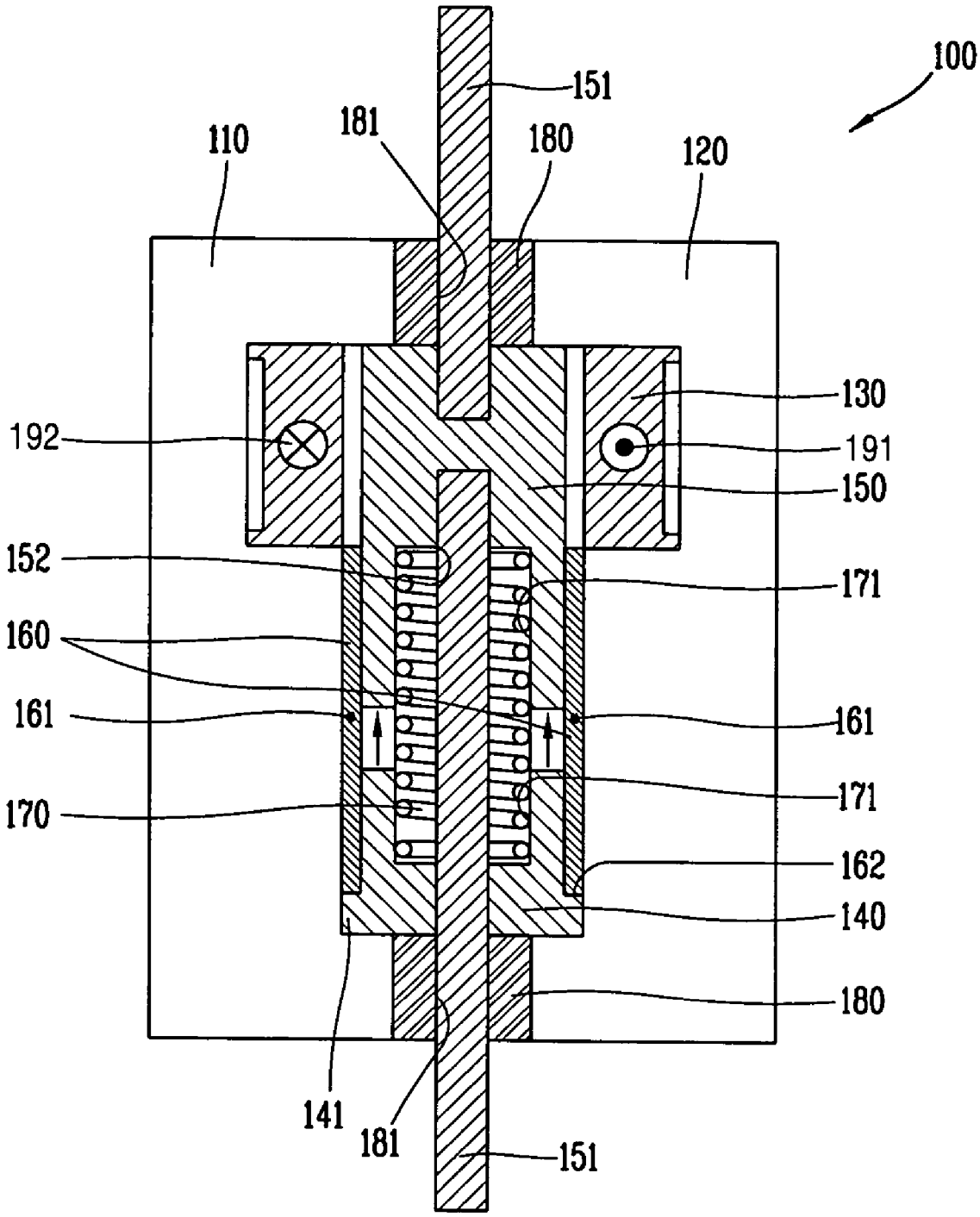

FIG. 3 is a perspective view showing an actuator using a permanent magnet according to the present invention, FIG. 4 is a longitudinal section view showing the actuator using a permanent magnet according to the present invention, FIG. 5 is a longitudinal section view showing another example of a rod portion of the actuator using a permanent magnet according to the present invention, and FIGS. 6 and 7 are longitudinal section views showing an operation of the actuator using a permanent magnet according to the present invention.

As shown, according to an actuator 100 using a permanent magnet according to the present invention, a mover 150 is fast upwardly moved by a magnetic force generated by a bobbin coil 130 and an elastic force of an elastic member 170 with a small current.

The actuator 100 using a permanent magnet according to the present invention comprises a first core 110 and a second core 120 facing each other with a certain gap and having a space 100*a* therein; a hollow bobbin coil 130 fixedly installed at one side of the space 100*a* for generating a magnetic force at the time of a current supply; a stator 140 fixedly installed at another side of the space 100*a* with a certain gap from the bobbin coil 130; a mover 150 linearly moving in the space 100*a* by a magnetic force generated by the bobbin coil 130, and having a rod portion 151 exposed to outside of the first core 110 and the second core 120; and a permanent magnet 160 fixedly installed at an inner surface of the space 100*a* for fixing the mover 150.

The bobbin coil 130 is installed at an upper side of the space 100*a* as a cavity form, and the mover 150 is movably disposed at the center of the bobbin coil 130.

An elastic member 170 for elastically linear-moving the mover 150 is disposed between the mover 150 and the stator 140. As the elastic member 170, a compression spring is used.

A receiving groove 171 for receiving both ends of the elastic member 170 is formed at a contact surface between the mover 150 and the stator 140.

As shown in FIG. 4, the receiving groove 171 can be formed at both the mover 150 and the stator 140, or can be formed at either the mover 150 or the stator 140 (not shown).

A bearing block 180 is installed between the first core 110 and the second core 120, and an insertion hole 181 for inserting the rod portion 151 is formed at the center of the bearing block 180.

The bearing block 180 connects the first core 110 and the second core 120 to each other, and serves as a bearing.

A flange portion 141 is extendingly formed at an outer circumferential surface of the stator 140, and a lower end 162 of the permanent magnet 160 is supported by the flange portion 141.

The permanent magnets 160 are disposed to face each other on the basis of the mover 150.

The rod portion 151 is fitted into a mounting groove 152 formed at the mover 150. As shown in FIG. 4, each rod portion 151 provided at both sides of the mover 150 can be formed to be separated from each other. Also, as shown in FIG. 5, each rod portion 251 can be formed to be integral with each other.

Unexplained reference numeral 191 denotes an outward direction of a current applied to the bobbin coil, and 192 denotes an inward direction of a current applied to the bobbin coil.

An operation of the actuator using a permanent magnet will be explained.

Referring to FIG. 6, a tension force is applied to the mover by the permanent magnet. Accordingly, the end of the mover 150 is in contact with the stator 140, and the elastic member 170 is compressed (hereinafter, the sate will be referred to as 'an initial state').

Under the initial state, when the actuator 100 is driven in order to switch a contact point of a vacuum circuit breaker or a high speed transfer switch, a current is applied to the bobbin coil 130 from the direction of 191 to the direction of 192. As the result, a magnetic force generated from the bobbin coil 130 becomes greater than a magnetic force of the permanent magnet 160. That is, since the tension force applied to the mover 150 by the permanent magnet 160 is greater than the tension force applied to the mover 150 by the bobbin coil 130, the mover 150 is upwardly moved. At the same time, the elastic force of the elastic member 170 is used to fast move the mover 150 upwardly.

When the end of the mover 150 passes through a middle point 161 of the permanent magnet 160 as the mover 150 upwardly moves, the tension force applied to the mover 150 by the permanent magnet 160 becomes weak. Accordingly, the mover 150 fast moves upwardly.

Referring to FIG. 7, when a current is applied to the bobbin coil 130 from the direction of 191 to the direction of 192 in order to downwardly move the mover 150, the mover 150 is downwardly moved by a magnetic force generated from the bobbin coil 130 and the elastic member 170 is compressed.

When the end of the mover 150 passes through the middle point 161 of the permanent magnet 160 as the mover 150 downwardly moves, the tension force applied to the mover 150 by the permanent magnet 160 becomes great. Accordingly, the mover 150 fast moves downwardly by a magnetic force generated from the bobbin coil 130 and a magnetic force generated from the permanent magnet 160.

The mover 150 having downwardly moved returns to the initial state shown in FIG. 6.

As aforementioned, when the actuator 100 is driven under an initial state in order to drive a contact point of a vacuum circuit breaker or a high speed transfer switch, the mover 150 is upwardly moved faster by an elastic force of the elastic member 170. Accordingly, the initial driving of the actuator can be performed even with a small current.

According to the actuator using a permanent magnet of the present invention, one bobbin coil is provided thus to lower a production cost, and a driving function is enhanced. Accordingly, the actuator can be widely applied to a vacuum circuit breaker or a high speed transfer switch requiring a fast driving.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An actuator using a permanent magnet, comprising:

a first core and a second core facing each other with a certain gap and having a space therein;

a single hollow bobbin coil fixedly installed at one side of the space for generating a magnetic force at the time of a current supply;

a stator fixedly installed at another side of the space with a certain gap from the bobbin coil;

a mover linearly moving in the space by a magnetic force generated by the bobbin coil, and having a rod portion exposed to outside of the first core and the second core;

an elastic member disposed between the mover and the stator for elastically linear-moving the mover; and a permanent magnet fixedly installed at an inner surface of the space for fixing the mover.

2. The actuator of claim 1, wherein a receiving groove for receiving both ends of the elastic member is formed at a contact surface between the mover and the stator.

3. The actuator of claim 1, further comprising a bearing block installed between the first core and the second core for connecting the first core and the second core, and having an insertion hole for inserting the rod portion at a center thereof.

4. The actuator of claim 2, further comprising a bearing block installed between the first core and the second core for connecting the first core and the second core, and having an insertion hole for inserting the rod portion at a center thereof.

5. The actuator of claim 1, wherein a flange portion is extendingly formed at an outer circumferential surface of the stator, and an end of the permanent magnet is supported by the flange portion.

6. The actuator of claim 1, wherein the permanent magnets are disposed to face each other on the basis of the mover.

7. The actuator of claim 1, wherein the rod portion is fitted into a mounting groove formed at the mover.

8. The actuator of claim 1, wherein each rod portion provided at both sides of the mover is formed to be separated from each other.

9. The actuator of claim 1, wherein the elastic member is a compression spring.

10. The actuator of claim 1, wherein the mover is positioned at a center of the bobbin coil.

11. The actuator of claim 1, wherein one end of the elastic member is received within a receiving groove of the mover, and another end of the elastic member is received within a receiving groove of the stator.

12. The actuator of claim 1, further comprising a bearing block installed between the first core and the second core for connecting the first core and the second core, and having an insertion hole for inserting the rod portion at a center thereof.

* * * * *